US005503338A

United States Patent [19]

Thom, Jr.

[11] Patent Number: 5,503,338

[45] Date of Patent: Apr. 2, 1996

[54] REGRIND DEFLECTORS FOR HAMMERMILLS

[75] Inventor: Kelsey C. Thom, Jr., Cedar Falls, Iowa

[73] Assignee: Roskamp Champion, Waterloo, Iowa

[21] Appl. No.: 425,320

[22] Filed: Apr. 17, 1995

Related U.S. Application Data

[63] Continuation of Ser. No. 169,265, Dec. 20, 1993, abandoned.

[51] Int. Cl.[6] ..... B02C 13/284

[52] U.S. Cl. ..... 241/73; 241/88; 241/89.2; 241/189.1

[58] Field of Search ..... 241/73, 74, 88, 241/88.2, 88.3, 89.2, 189.1

[56] References Cited

U.S. PATENT DOCUMENTS

| | | | |
|---|---|---|---|
| 2,996,260 | 8/1961 | Carder | 241/73 |

FOREIGN PATENT DOCUMENTS

| | | | |
|---|---|---|---|
| 754537 | 3/1967 | Canada | 241/74 |
| 627853 | 10/1978 | U.S.S.R. | 241/74 |
| 1329820 | 8/1987 | U.S.S.R. | 241/74 |
| 16769 | of 1914 | United Kingdom | 241/74 |

*Primary Examiner*—Timothy V. Eley
*Attorney, Agent, or Firm*—Robert F. Palermo; Michael H. Minns

[57] ABSTRACT

A regrind deflector for an apertured screen in a hammermill has a plate extending along substantially the entire length of the screen and having a straight surface smoothly blending to a curved surface, the straight surface beginning at an inner surface of the screen and substantially tangent thereto and extending outwardly to the curved surface which curves back inwardly to the inner surface of the screen and intersects therewith at an angle of less than 90 degrees. The number of deflectors required depends on hammermill size and operating conditions as well as characteristics of the feed material to be processed.

5 Claims, 2 Drawing Sheets

REGRIND DEFLECTORS FOR HAMMERMILLS

This application is a continuation of application Ser. No. 08/169,265, filed Dec. 20, 1993 now abandoned.

BACKGROUND OF THE INVENTION

This invention relates generally to hammermills and, more particularly, to devices for increasing the number of impacts of hammers upon the feed material to be ground.

Hammermills used for grinding or comminuting materials commonly consist of a large housing having a feed material inlet at the top, a grinding chamber below the feed material inlet, and a ground material outlet below the grinding chamber. The grinding chamber is defined by an apertured screen extending downwardly from one edge of the feed material inlet and curving about to form a partly cylindrical surface before extending back upwardly to the other edge of the inlet. The resulting cross-sectional shape is roughly a teardrop formed by a circular lower portion bounded by two straight tangent lines converging toward the edges of the feed material inlet. The apertured screen provides the wall of the grinding chamber and surrounds a rotor mounted coaxially in the cylindrical portion of the grinding chamber. On the rotor, a number of hammer bars are pivotably mounted to be free to swing when the rotor is rotated.

During rotation, the outboard ends of the hammers pass closely along the surface of the apertured screen, impacting upon the feed materials and, thereby, comminuting the materials until the particles are fine enough to pass through the apertured screen to the particle outlet of the housing of the hammermill.

During grinding of a material in a hammermill, the particles of the material, after the first impact of the hammers, very quickly attain the velocity of the hammers tangentially to the screen surface. This is partly due to the impact and partly due to the fanning action of the rotor on the air in the grinding chamber. Of course, the low angle of contact of the particles with the screen prevents passage of even the properly sized particles through the apertures so that the particles travel along the screen surface at approximately the same velocity as do the hammer tips. This results in a very low number of low-energy impacts and an unsatisfactory production rate.

One attempt to alleviate this condition included a U-shaped channel extending axially along the bottom inner surface of the apertured screen. By interrupting the smooth surface of the screen, this disrupts the flow of air and particles along the screen. It slows and deflects particles into the path of the hammers, thereby intensifying the grinding action of the mill. Particles are thus ground more quickly to a finer particle size so that they pass more easily through the apertures of the screen and increase the rate of production. However, one disadvantage of this device has been a great increase in energy consumption for the hammermill per unit of milled feed material. This is due to some of the particles becoming trapped in eddies within the U-channel so that following particles flow past along the screen surface as though the channel were full. This results in the particles losing energy as they slow down. They are then struck by the hammers, but, since they are travelling only slightly slower than the hammers, the impacts do not cause comminution of the particles to the degree necessary for efficient operation. Reduced flow rate and reduced impact energy decreases material spread over the screen and decreases the speed of particles sifting through the screen. In order to achieve the required degree of grinding, additional energy in the form of longer running time must be supplied to the hammers. Aside from the increased energy consumption, there is a significant increase in wear and tear on the hammermill components, as evidenced by increased frequency of maintenance and repairs for a given production level.

The foregoing illustrates limitations known to exist in present agricultural hammermills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a regrind deflector for an apertured screen in a hammermill. The regrind deflector comprises a plate which extends along substantially the entire length of the screen. The plate has a predetermined shape which is defined by a first straight surface which smoothly blends into a second curved surface. The first straight surface begins at an inner surface of the screen in an orientation substantially tangent thereto. The plate extends outwardly to the second curved surface which curves back inwardly to the screen inner surface. The second curved surface forms an angle of less than 90 degrees as measured between the second curved surface and a portion of the inner surface of the screen which is disposed after the second curved surface, as determined by the direction of travel of the hammers of the hammermill.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
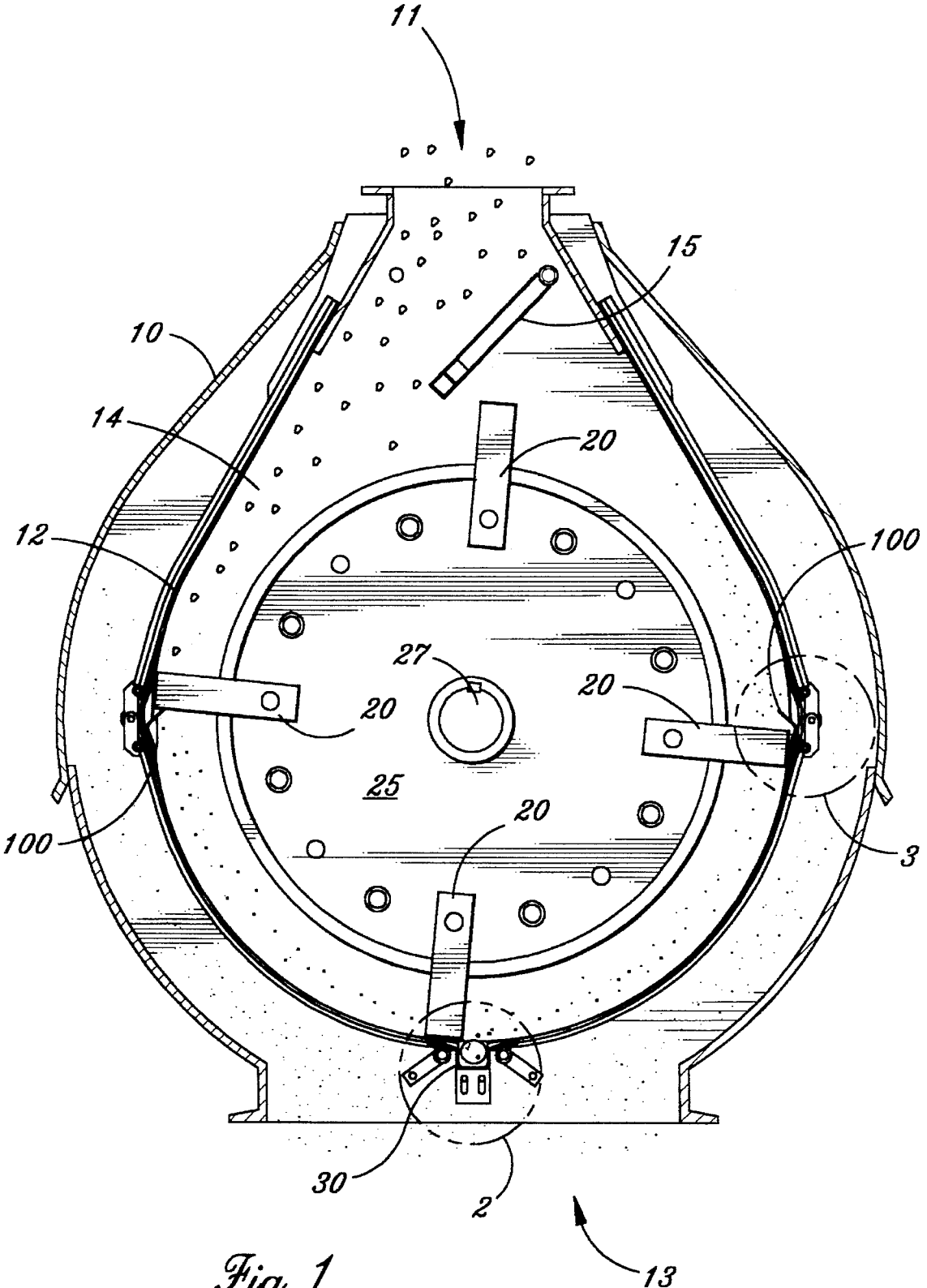
FIG. 1 is vertical cross-sectional axial schematic view of a hammermill grinding chamber within a mill housing.

Referring to FIG. 1, a sectional view of a hammermill shows a housing 10 with a feed material inlet 11 at the top, a ground particle discharge 13 at the bottom, a screen 12 having a generally tear drop shaped cross-section and being suspended from both edges of the material inlet 11 so as to receive all feed material coming through the inlet, a rotor 25 rotatably mounted on a driven shaft 27 and equipped with a plurality of hammers 20 which are free to swing when the rotor is rotated, and a grinding chamber 14 which is defined by the space between screen 12 and rotor 25 through which hammers 20 swing. An anti-reflux gate 15 prevents feed material from being driven upwardly through inlet 11 by impacts with hammers 20. During operation, feed material enters through the material inlet 11 and falls into the grinding chamber 14 where it is repeatedly struck by the rapidly swinging hammers 20 until it has been ground sufficiently fine to pass through apertures 120 of screen 12, after which, it passes through discharge 13 and is removed to its next processing step. The U-channel 30 serves to disrupt flow of air and particles along the screen, so that particles are deflected into the path of the hammers and grinding rate is improved, so long as blinding of the channel due to eddy currents of air and particles does not occur. This describes the general operation of a hammermill incorporating the U-channel of the prior art.

For convenience only, FIG. 1 also shows both the U-shaped channel 30 of the prior art in the area bounded by circle 2 and the regrind deflector 100 of the present invention in the area bounded by circle 3 in order to illustrate the environment in which the devices operate. These features would not be combined in practice. Rather, in the prior art, one U-channel 30 was provided, as illustrated, and the remaining surface of screen 12 was unbroken except by perforations 120. If regrind deflector 100 of the present invention is included, it is included in all three locations including that occupied by circle 3 in FIG. 1. This is done to maximize efficiency and productivity of grinding in the mill.

Figure 2:
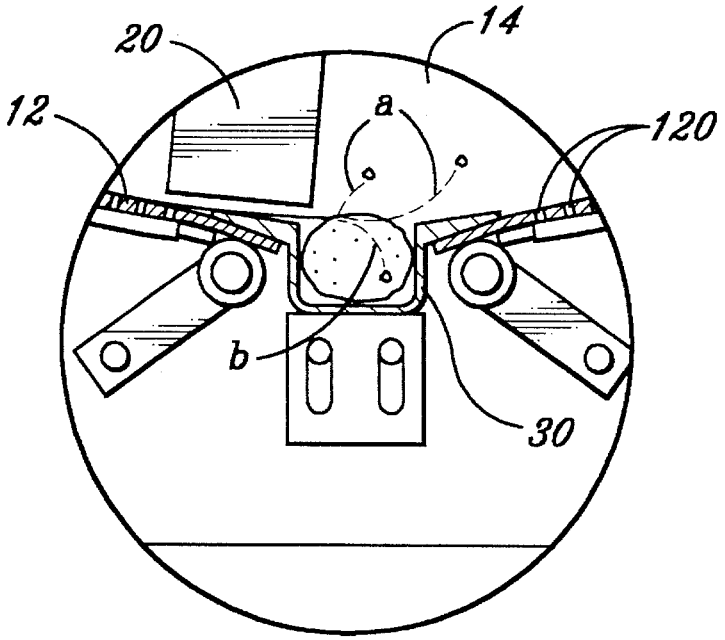
Fig. 2 (PRIOR ART)
FIG. 2 is an enlarged fragmentary view showing additional detail of the U-channel of the prior art in area 2 of FIG. 1.

FIG. 2 is an enlarged view of the prior art U-channel 30 showing additional detail of its structure and function. In this view, hammer 20 is shown passing very close to screen 12 and the edge of U-channel 30. Particles (un-numbered) are also shown in or near the channel. Two paths, a and b, are shown to illustrate the two main effects of the U-channel on the paths of particles; namely, the partial elimination of tangential motion of the particles and deflection of some particles radially into the path of the hammers 20 (path a), and entrapment of particles in eddy currents of air within the U-channel (path b). This results in more intense grinding but at a disproportionate increase in energy consumption as previously described. Decreased particle flow rate and material spread over the screen reduces the rate of sifting of particles through the screen. Thus, even though the U-channel can help to improve grinding efficiency, the benefit is not fully realized because of the losses described above.

Figure 3:
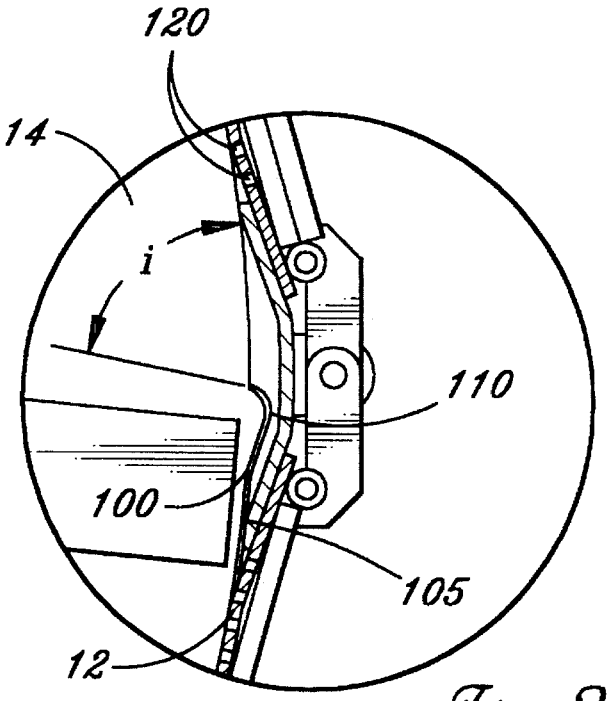
FIG. 3 is an enlarged fragmentary view showing additional detail of area 3 of FIG. 1 which illustrates the preferred embodiment of the present invention.

FIG. 3 shows the regrind deflector 100 of the present invention. It is made up of a plate having a straight surface 105 and a curved surface 110 which are smoothly blended together. Straight surface 105 is joined to screen 12 and is substantially tangent thereto, while curved surface 110 blends from straight surface 105 back inwardly towards the inner surface of screen 12 to form an angle "i" as measured between the curved surface 110 and a portion of the inner surface of the screen 12 which is disposed after the curved surface 110, as determined by the direction of travel of the hammers 20 of the hammermill. Angle "i" is slightly less than 90 degrees so that the deflector 100 forms a shallow longitudinal bulge in the portion of the screen 12 having a cylindrical shape. Eddy current formation is avoided by the self purging character of angle "i" being less than 90 degrees. One or more such deflectors are added to a hammermill to perturb the flow of particles and air, thereby exposing the particles to multiple hammer impacts. This maintains grinding action and, since it does not permit formation of air/particle eddies as does the U-channel, it does not impose the same energy consumption penalty as the U-channel of the prior art.

Preferably, three deflectors 100 are in a mill so that there is virtually no purely tangential particle motion. This assures multiple hammer impacts on each particle for each trip around the grinding chamber which results in quicker particle size reduction, improved spread of material along the screen 12, and increased rate of sifting of ground material through the screen 12. Achievement of these improvements by deflector 100 is due in part to addition of a radial component to the particle travel, thereby reducing the energy penalty, increasing the angle at which particles impinge upon the screen 12, and dispersing particles more uniformly around the grinding chamber 14.

The number of regrind deflectors required depends on the size of the hammermill, the speed of the rotor, and the characteristics of the grain being processed. Thus, a large diameter mill with a high speed rotor will require more deflectors than will a smaller and slower mill; because of the increased tendency of the particles to assume the tangential flow mode on the more gradual arc of a larger screen. In any given mill, grains with high impact resistance require more impacts for proper grinding and, therefore, more deflectors.

What is claimed is:

1. In a hammermill of the type used for comminuting materials, the hammermill having a housing with a top inlet, a bottom discharge, and a working chamber defined by an apertured screen surrounding a rotatably driven axle supporting a rotor having a plurality of hammers which are free to swing when the rotor rotates upon the axle, the improvement comprising:

a means for substantially eliminating purely tangential motion of the materials being comminuted within the working chamber, said means being disposed below the surface of the screen, and said means being located at at least one site along a periphery of said screen and extending substantially over the full axial extent of said screen.

2. The hammermill according to claim 1, wherein the means for substantially eliminating purely tangential motion of the materials being comminuted includes a curved plate, the radius and curvature of the curved plate increasing in the direction of the rotor rotation.

3. In a hammermill for comminuting materials, the hammermill having a comminuting chamber defined between an apertured screen and a rotor which is mounted on a driven shaft and which is equipped with a plurality of hammers, a regrind deflector comprising:

a plate extending along substantially the entire length of said screen, the plate having a first straight surface smoothly blending to a second curved surface, the first straight surface beginning at an inner surface of the apertured screen in an orientation substantially tangent thereto, the plate extending outwardly to said second curved surface which curves back inwardly to said inner surface of said screen to form an angle of less than 90 degrees as measured between the second curved surface and a portion of the inner surface of the screen which is disposed after the second curved surface, as determined by the direction of travel of the hammers of the hammermill, the second curved surface being disposed at or below the inner surface of the screen and being formed to deflect materials to be comminuted in a direction radially inwardly toward the rotor.

4. In a hammermill of the type used for comminuting materials, the hammermill having a housing with a top inlet, a bottom discharge, and a working chamber defined by an apertured screen surrounding a rotatably driven axle supporting a rotor having a plurality of hammers which are free to swing when the rotor rotates upon the axle, the improvement comprising:

means for radially deflecting materials to be comminuted, inwardly in a direction toward the rotor, into the path of the hammers, said means being located at at least one site along a periphery of said screen and extending substantially over the full axial extent of said screen, the means for radially deflecting materials comprising a plate having a straight surface smoothly blending to a curved surface, the straight surface beginning at an inner surface of the screen in an orientation substantially tangent thereto, the plate extending outwardly to said curved surface which curves back inwardly to said inner surface of said screen to form an angle of less than 90 degrees as measured between the second curved surface and a portion of the inner surface of the screen which is disposed after the second curved surface, as determined by the direction of travel of the hammers of the hammermill.

5. A hammermill comprising:

a housing having a top inlet and a bottom discharge;

a rotatably driven axle mounted within the housing;

a rotor supported by the axle, the rotor having a plurality of hammers for comminuting materials, the rotors being free to swing when the rotor rotates upon the axle;

an apertured screen mounted within the housing such that the apertured screen communicates with the inlet;

a working chamber defined by a void between the apertured screen and the rotor; and a means for substantially eliminating purely tangential motion of the materials being comminuted within the working chamber, said means including at least three plates extending along substantially the entire length of said screen, and wherein each of the at least three plates has a first straight surface smoothly blending to a second curved surface, the first straight surface beginning at an inner surface of the apertured screen in an orientation substantially tangent thereto, each plate extending outwardly to said second curved surface which curves back inwardly to said inner surface of said screen to form an angle of less than 90 degrees as measured between the second curved surface and a portion of the inner surface of the screen which is disposed after the second curved surface, as determined by the direction of travel of the hammers of the hammermill, the second curved surface being disposed at or below the inner surface of the screen and being formed to deflect materials to be comminuted in a direction radially inwardly toward the rotor.

* * * * *